US010836621B2

(12) United States Patent
Meinzinger

(10) Patent No.: US 10,836,621 B2
(45) Date of Patent: Nov. 17, 2020

(54) METHOD AND DEVICE FOR FILLING A CONTAINER TO BE FILLED WITH A FILLING PRODUCT

(71) Applicant: Krones AG, Neutraubling (DE)

(72) Inventor: Rupert Meinzinger, Kirchroth (DE)

(73) Assignee: KRONES AG, Neutraubling (DE)

( * ) Notice: Subject to any disclaimer, the term of this patent is extended or adjusted under 35 U.S.C. 154(b) by 186 days.

(21) Appl. No.: 14/678,850

(22) Filed: Apr. 3, 2015

(65) Prior Publication Data

US 2015/0284233 A1 Oct. 8, 2015

(30) Foreign Application Priority Data

Apr. 4, 2014 (DE) ..... 10 2014 104 872

(51) Int. Cl.

| | |
|---|---|
| ***B67C 3/10*** | (2006.01) |
| ***B67C 3/26*** | (2006.01) |
| ***B67C 3/16*** | (2006.01) |
| ***B67C 3/12*** | (2006.01) |

(52) U.S. Cl.

CPC ..... *B67C 3/10* (2013.01); *B67C 3/12* (2013.01); *B67C 3/16* (2013.01); *B67C 3/26* (2013.01); *B67C 3/2634* (2013.01)

(58) Field of Classification Search

CPC .... B67C 3/16; B67C 3/26; B67C 3/12; B67C 3/10; B67C 3/2634; G01F 23/14

USPC ..... 141/6, 61, 66, 65, 38, 39; 73/290 R, 73/290 B, 149

See application file for complete search history.

(56) References Cited

U.S. PATENT DOCUMENTS

| | | | | |
|---|---|---|---|---|
| 270,434 A * | 1/1883 | Hunt et al. | B67C 3/16 | 141/54 |
| 582,285 A * | 5/1897 | Henes | B67C 3/06 | 141/230 |
| 1,866,653 A * | 7/1932 | Jauch | B60S 5/046 | 137/224 |
| 2,124,581 A | 7/1938 | Robert | | |
| 2,174,384 A * | 9/1939 | Fouser | B67C 3/06 | 141/39 |
| 2,285,151 A * | 6/1942 | Firestone | G01F 17/00 | 73/149 |

(Continued)

FOREIGN PATENT DOCUMENTS

| | | |
|---|---|---|
| CN | 101503172 | 8/2009 |
| CN | 201288055 | 8/2009 |

(Continued)

OTHER PUBLICATIONS

Search Report, dated Oct. 28, 2015, 8 pages, German Patent Application No. 10 2014 104 872.5.

(Continued)

*Primary Examiner* — Timothy L Maust
*Assistant Examiner* — James R Hakomaki
(74) *Attorney, Agent, or Firm* — Haynes and Boone, LLP

(57) ABSTRACT

A method for filling a container to be filled with a fill product is described. The method includes connecting the container to be filled with a product fill pipe, determining the initial pressure in the container to be filled, filling the container to be filled, and stopping the filling of the container when a predetermined cut-off pressure is reached in the container.

18 Claims, 1 Drawing Sheet

(56) References Cited

U.S. PATENT DOCUMENTS 3,037,536 A * 6/1962 Fechheimer ..... B67C 3/16 141/7
3,060,735 A * 10/1962 Baker ..... G01F 17/00 73/149
3,527,267 A * 9/1970 Moore ..... B67C 3/26 141/198
4,254,804 A * 3/1981 Wada ..... B67C 3/283 141/302
4,416,844 A * 11/1983 Wyman ..... B29D 30/04 152/310
4,553,431 A * 11/1985 Nicolai ..... G01F 17/00 73/149
4,637,438 A * 1/1987 Weiss ..... B67C 3/10 141/39
4,655,029 A * 4/1987 Weiss ..... B67C 3/10 141/6
4,763,518 A * 8/1988 Daviaud ..... G01F 17/00 141/5
4,949,764 A * 8/1990 Clusserath ..... B67C 3/06 141/39
4,989,650 A * 2/1991 Weiss ..... B67C 3/06 141/198
5,000,234 A * 3/1991 Weiss ..... B67C 3/10 141/40
5,016,684 A * 5/1991 Clusserath ..... B67C 3/06 141/39
5,082,033 A * 1/1992 Weiss ..... B67C 3/06 141/198
5,240,048 A * 8/1993 Diehl ..... B67C 3/12 141/39
5,320,144 A * 6/1994 Ahlers ..... B67C 7/0073 141/1
5,513,678 A * 5/1996 Schultz ..... F17C 5/06 141/198
5,634,500 A * 6/1997 Clusserath ..... B67C 3/10 141/44
5,642,761 A * 7/1997 Holbrook ..... B67C 3/06 141/104
5,819,816 A * 10/1998 Mayer ..... B65B 3/28 141/83
6,457,495 B1 * 10/2002 Meheen ..... B67C 3/10 141/40
6,474,368 B2 * 11/2002 Clusserath ..... B67C 3/286 141/129
2001/0045242 A1 * 11/2001 Clusserath ..... B67C 3/12 141/144
2005/0016267 A1 * 1/2005 Doorhy ..... G01F 23/18 73/299
2007/0062160 A1 * 3/2007 Stadlmayr ..... A23L 2/54 53/403
2009/0165477 A1 * 7/2009 Sturken ..... A47J 31/4485 62/129
2010/0154925 A1 * 6/2010 Steele ..... B60S 5/046 141/38

FOREIGN PATENT DOCUMENTS

| | | |
|---|---|---|
| DE | 10008426 | 5/1957 |
| DE | 8308618 | 7/1983 |
| DE | 8308806 | 8/1983 |
| EP | 0291971 | 11/1988 |
| JP | 2001261096 | 9/2001 |
| JP | 4003020 | 11/2007 |

OTHER PUBLICATIONS

Chinese Office Action, Chinese Patent Application No. 201510151754.X, dated Nov. 28, 2016, 8 pages.
Office Action issued in related European Patent Application No. 15162344.4 dated Dec. 8, 2017.
Official Notification of Reason for Rejection in related Japanese application 2015-077712, dated Jan. 28, 2019 (English translation is included).

* cited by examiner

METHOD AND DEVICE FOR FILLING A CONTAINER TO BE FILLED WITH A FILLING PRODUCT

CROSS REFERENCE TO RELATED APPLICATIONS

This application claims priority from German Patent Application No. DE 10 2014 104 872.5, filed on Apr. 4, 2014 in the German Patent and Trademark Office, the disclosure of which is incorporated herein by reference in its entirety.

BACKGROUND

Technical Field

The present invention relates to a method and a device for filling a container with a fill product, and in particular for filling a container with a beverage in a beverage filling plant.

Related Art

In beverage filling plants, it is known to fill containers with a fill product by means of filling elements. In this case, each filling element has a product fill pipe, which can be connected with the container that is to be filled and which can be charged with the fill product via a filler valve, in order to convey the fill product into the container. By means of the opening and closing of the filler valve, the flow of fill product into the container to be filled is controlled, and the volume of fill product introduced into the container to be filled is correspondingly regulated.

Particularly when the container is to be filled with a carbonated fill product, for example a carbonated beverage such as beer, mineral water or soft drinks, the product fill pipe is connected with the container to be filled in a pressure-tight manner. Before being filled with the applicable carbonated fill product, the container to be filled is pre-pressurized with a pressure gas to an overpressure. Only when it has been thus pre-pressurized is the container filled with the fill product. As the pressure gas, $CO_2$ is for example used. Accordingly, during the filling of the container to be filled, the bound $CO_2$ in the carbonated fill product is filled against the increased $CO_2$ pressure, so that the release of the $CO_2$ from the fill product can be reduced or prevented entirely. In this manner, it is possible to reduce or prevent foaming of the fill product in the container to be filled, so that in this manner the filling process as a whole is accelerated. This method is also known as the counter-pressure filling method.

The closing of the filler valve can be controlled by means of a flow meter, by means of which a predetermined volume of fill product can be measured off and the filling element can be caused to close when the predetermined volume of fill product is reached.

It is further known to pre-dose, by means of a dosing chamber, the volume of fill product that is to be introduced into the container to be filled, wherein the dosing chamber typically has a calibrated volume. In order to fill the container to be filled, the entirety of the product accommodated in the dosing chamber is discharged into the container to be filled. The filler valve accordingly closes when all of the fill product has flowed out of the dosing chamber.

In addition to the method described above for filling, with a predetermined fill volume, a container to be filled, it is also known to fill the container to be filled to a predetermined fill height. Various methods to achieve this are known. For example, it is known to insert a height probe into the container to be filled. This height probe closes the filler valve, for example by means of the completion of an electrical circuit, when a predetermined fill product level is reached.

A so-called vacuum fill method is also known, in which still fluids are introduced into a pre-evacuated container to be filled. Exact adjustment of the fill height takes place by means of dipping a suction tube into the container, which has been filled with fill product, and drawing the fill product back out of the container by means of an underpressure applied to the suction tube until the desired fill level, which is defined by the lower end of the suction tube, is reached. In this, the suction tube is in fluid communication with the underpressure applied to the fill product in the fill product reservoir, making it possible to achieve rapid extraction of the fluid by suction, and retention of the fill product in the suction tube without dripping. Examples of such vacuum fillers can be found in DE 83 08 618 U1 and DE 83 08 806 U1.

These vacuum fill devices and vacuum fill methods are not used for filling carbonated beverages, since the underpressure or vacuum that is applied would immediately release the $CO_2$ in the applicable carbonated beverages, and thus result in a filling process with a high tendency to produce foam, and hence a long filling time. Accordingly, the use of vacuum fill methods to fill carbonated beverages is excluded in the state of the art.

It is further known to control the filling of a container to be filled by means of the determination of the fill weight. For this purpose, the container to be filled is combined with a weighing cell which measures the weight of fill product introduced into a container to be filled. When a predetermined fill weight is reached, the filler valve is closed. If the density of the fill product is known, the volume that has been filled can also be deduced from the fill weight, and when a predetermined fill volume is reached, the filler valve can be closed.

The methods for filling a container to be filled that are known from the state of the art require additional components (flow meter, dosing chamber, height probe, return air tube, weighing cell), which make the device as a whole more complex and need additional cleaning and maintenance.

SUMMARY

A method and a device for filling a container with a fill product, which provides an alternative method for determining the end of filling is provided.

In exemplary embodiments, a method for filling a container to be filled with a fill product includes the steps of connecting the container to be filled with a product fill pipe, determining the initial pressure in the container to be filled, filling the container to be filled with the fill product, and ending the filling of the container to be filled when a predetermined cut-off pressure is reached in the container. In some embodiments, the container and the product fill pipe are securely connected in a pressure-tight manner.

Because the filling of the container to be filled is ended when a predetermined cut-off pressure is reached in the container, good dosing accuracy can be achieved. The dosing accuracy in this case is independent of the velocity of flow of the fill product and of the filling time, since only the initial pressure is taken into account at the start. The dosing accuracy is also independent of the volume to be filled, and in particular can also be applied to the filling of containers with small volumes of about 0.2 L to 0.5 L. In this manner, it is also in particular possible, when the filling takes place in a sudden burst, to end reliably the filling with the fill product of the container to be filled when the desired fill volume is reached.

In order to carry out the method, only the determination of the pressure in the container to be filled is necessary, with the result that the construction has a low degree of complexity. In certain embodiments, for example, it is possible to provide either a central pressure gauge or a pressure gauge on each filling element of a beverage filling plant, for example in a rotary filler.

If the container to be filled is evacuated before being filled with the fill product, or it is at an underpressure with respect to the fill product supplied in a fill product feed, the fill product is discharged into the container to be filled in a sudden burst as soon as the filler valve is opened. The pressure thereby rises correspondingly during the filling of the container with the fill product.

If the container to be filled was evacuated in this manner to an underpressure before filling, for example to an absolute pressure of about 0.5 to 0.05 bar, in another embodiment about 0.3 to 0.1 bar, and in a further embodiment about 0.1 bar, the filling with fill product will initially cause the space in the container that is not occupied by the residual gas to be filled with the fill product up to atmospheric pressure (1 bar absolute pressure).

Because the initial pressure in the container to be filled and the volume of the container to be filled are known, it is simple to determine from this information the volume of fill product that flows into the container to be filled until atmospheric pressure is reached. In this manner, a fill volume in the container can be determined on the basis alone of the initial pressure present in the container. Particularly, simple determination of the fill volume results if the fill product is supplied at atmospheric pressure, since in this case the fill volume can be deduced simply and directly via the initial pressure of the container to be filled, and/or the fill volume can be varied by means of variation of the initial pressure in the container to be filled.

If for example, a headroom volume of 5% of the total volume is required in the container to be filled, this target can be reached by evacuating the container to be filled to 0.05 bar and subsequently filling it with the fill product to atmospheric pressure. The cut-off pressure is the atmospheric pressure, which is then established in equilibrium in the fill product feed and the container. This calculation does not, however, take into account the volume of the product fill pipe, which would have to be included for a still more precise determination of the fill volume.

If the fill volume that is reached in this manner is not yet the desired fill volume, it is possible, based on the knowledge of the initial pressure in the container to be filled, to determine the cut-off pressure to which the pressure in the container still needs to rise in order to introduce the required additional volume into the container while compressing the residual gas.

In a case in which the fill product is supplied at the cut-off pressure in order to reach equilibrium when the cut-off pressure is reached, it may be necessary to vary the pressure of the fill product over time. This is because the pressure which the fill product exerts on the container depends not only on the pressure at which the fill product is supplied, but also on the hydrostatic pressure of the fill product, i.e. of the fluid column that bears on the container. This fluid column can, however, vary, particularly if the fill product feed is via a fill product reservoir, for example a ring bowl or central vessel.

The cut-off pressure may be determined on the basis of the measured initial pressure, taking into account the desired fill volume, the volume of the container, and the volume contributed by the product fill pipe.

The fill product for filling the container to be filled is, in one embodiment, supplied at an absolute pressure of about 1 bar to 9 bar, in an alternative embodiment at an absolute pressure of about 2.5 bar to 6 bar, and in a further embodiment at an absolute pressure of about 2.8 bar to 3.3 bar, so that the pressure gradient between the fill product and the initial pressure present in the container to be filled results in the filling of the container to be filled taking place rapidly, and in some embodiments, in a sudden burst.

In an embodiment in which the cut-off pressure is equal to the pressure of the supplied fill product, particularly exact dosing can be achieved even if such filling takes place in a sudden burst. In particular, the initial phase of the filling process takes place extremely rapidly, i.e. in a sudden burst, and is gradually reduced before coming to a standstill when pressure equilibrium is reached between the pressure in the container and the pressure in the fill product feed. The filling process accordingly ends when the cut-off pressure is reached.

In some embodiments, the initial pressure in the container to be filled is adjusted according to the available cut-off pressure, so that the required fill volume can be achieved. In other words, if the pressure of the fill product varies, and this pressure is intended to be the cut-off pressure, the desired volume of fill product can be achieved by variation of the evacuation of the container.

In certain embodiments, during the filling of the fill product into the container, the fill product is at a higher pressure than the predetermined cut-off pressure. The flow of product therefore does not come to a standstill at the desired fill volume due to an equilibrium being reached with the pressure in the container, but must be actively ended. The filling process is accordingly ended actively when the predetermined cut-off pressure is reached, for example by the closing of a valve.

In other embodiments, the changing pressure in the container is measured, and when a predetermined rise in the pressure curve and/or a predetermined differential of the pressure curve is reached, the filling is ended, and in particular the filler valve is closed. It is thereby possible to end the filling when, for example, the pressure rises only slowly and the filling process can no longer be carried out efficiently. The rise is determined on the basis of the initial pressure and the desired fill volume, and corresponds to a predetermined cut-off pressure.

A device for filling a container with a fill product is also provided. The device includes a product fill pipe for connection with the container to be filled, wherein the product fill pipe can be brought into communication with a fill product feed via a filler valve. The device further includes a pressure gauge for determining the initial pressure in the container, and a control device, which is configured to open the filler valve after the initial pressure is determined and to close the filler valve when a predetermined cut-off pressure is reached in the container.

Due to the fact that the device needs only a pressure gauge to determine the initial pressure in the container to be filled, the design of the plant as a whole, and in particular of the components that serve to achieve a desired fill quantity or desired fill volume in the container to be filled, can be considerably simplified. Either the pressure gauge can be disposed on the product fill pipe of each filling element such that it can measure the pressure in the container to be filled and the pressure during the filling of the container, or else a plurality of filling elements, or in one embodiment, all filling elements, can be operated together by means of a single pressure gauge to determine the pressure that is present in the container to be filled and in the container as it is being filled.

For example, it can be possible to connect the product fill pipe with a vacuum device which provides an underpressure for the container to be filled before it is actually filled. This vacuum device can be provided as a central device serving all filling elements. Accordingly, the vacuum line, which supplies all filling elements with underpressure, can be monitored by means of a single pressure gauge, with the pressure that is measured at that point considered to be the pressure provided in the individual containers.

BRIEF DESCRIPTION OF THE FIGURES

Further embodiments and aspects of the present invention are more fully explained by the description below of the figures.

DETAILED DESCRIPTION

Examples of embodiments are described below with the aid of the figures. In the figures, elements which are identical or similar, or have identical effects, are designated with identical reference signs, and repeated description of these elements is in part dispensed with in the description below, in order to avoid redundancy.

Figure 1:
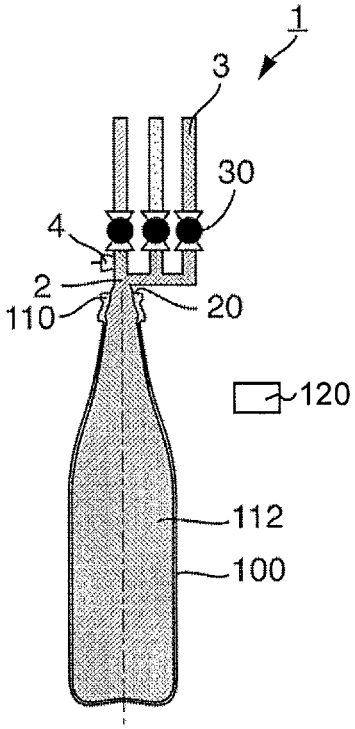
FIG. 1 illustrates a device for filling a container to be filled, with the container to be filled in a first state.

In FIG. 1, an exemplary device 1 for filling a container 100 to be filled with a fill product is shown. The device 1 includes a product fill pipe 2, which has a gripping bell 20 in which a mouth 110 of the container 100 to be filled can be accommodated in a secure manner. Accordingly, the internal space 112 of the container 100 to be filled may be connected in pressure-tight communication with the product fill pipe 2.

A vacuum line 3 is provided, which can be brought into connection via a vacuum valve 30 with the product fill pipe 2 and thereby also with the internal space 112 of the container 100 to be filled. The vacuum line 3 provides an underpressure in the region of an absolute pressure of about 0.5 bar to 0.05 bar, in some embodiments about 0.3 bar to 0.1 bar, and in further embodiments about 0.1 bar, with the result that after a certain time a corresponding underpressure with an absolute pressure of about 0.5 bar to 0.05 bar, in some embodiments about 0.3 bar to 0.1 bar, and in further embodiments about 0.1 bar, is established in the internal space 112 of the container 100.

Accordingly, when the container 100 to be filled is in the state shown schematically in FIG. 1, in which the vacuum valve 30 is open, it can be brought to a predetermined underpressure, which is measured as the initial pressure $P_{INI}$, for example by means of a pressure gauge 4 (shown only schematically). The pressure gauge 4 communicates with the product fill pipe 2 and therefore also with the internal space 112 of the container 100 to be filled. The pressure gauge 4 can thus also be used to determine the pressure in the internal space 112 of the container 100 after closure of the vacuum valve 30.

Alternatively, the pressure gauge 4 can be provided in the vacuum line 3 or at the vacuum source itself (not shown here), which may be for example a vacuum pump. The pressure gauge 4 first serves only to measure the initial pressure $P_{INI}$ in the container 100 to be filled. If the pressure gauge 4 is disposed in the vacuum line 3 or at a vacuum source itself, it may be assumed that the pressure that is provided in the vacuum line 3 or by the vacuum source will also be reached after a short time in the internal space 112 of the container 100 to be filled. In this manner, the pressure in the internal space 112 of the container 100 to be filled can also be determined reliably by means of a pressure gauge 4 disposed in the vacuum line 3 or at the vacuum source.

Figure 2:
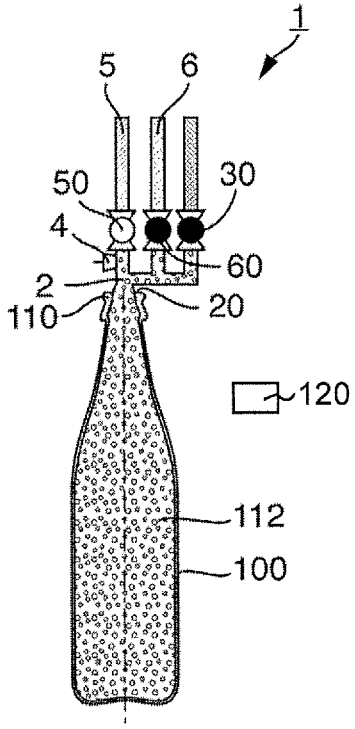
FIG. 2 illustrates the device of FIG. 1 in a second state.

In FIG. 2, the device 1 for filling a container 100 is shown in a second state of the method. The vacuum valve 30 is closed and a filler valve 50 is open, thus establishing, via the product fill pipe 2, a connection between a fill product feed 5 and the internal space 112 of the container 100 to be filled. Accordingly, the fill product present in the fill product feed 5 can enter the container 100.

The fill product in the fill product feed 5 is, in various embodiments, at an overpressure with respect to the initial pressure $P_{INI}$ present in the container 100, for example at an absolute pressure of about 1 to 9 bar.

This enables the fill product to be supplied at an overpressure corresponding to the atmospheric pressure, for example at an absolute pressure of about 1 bar. The overpressure is thus to be regarded as overpressure with respect to the underpressure established in the container 100, with the result that a pressure gradient exists between the fill product that is supplied and the container 100.

The overpressure of the fill product can also correspond to the saturated pressure of the fill product, and in some embodiments lie at an absolute pressure of about 1.1 bar to 6 bar. By means of an overpressure that corresponds to the saturated pressure, it is possible to counteract the release of $CO_2$ in a carbonated fill product.

In a further development, the overpressure of the fill product is higher than the saturated pressure of the fill product, and in certain embodiments lies at an absolute pressure of about 1.6 to 9 bar. A high degree of overpressure, which is in particular above the saturated pressure of the fill product, makes it possible for the $CO_2$ in the fill product to be at saturation, and at the same time for the pressure gradient between the supplied fill product and the container 100 to be greater, in order to accelerate the filling process still further.

Due to the fact that an underpressure is provided in the internal space 112 of the container 100, and the fill product in the fill product feed 5 is supplied at an overpressure, filling of the container 100 can take place in a sudden burst. The filler valve 50 is closed as soon as the predetermined cut-off pressure $P_{CUT}$ exists in the container 100 and hence the desired volume of fill product is present.

In order to determine when the filling process is completed, a control device 120 calculates on the basis of the initial pressure $P_{INI}$, which was measured in the container 100 before the opening of the filler valve 50, the portion of fill product that can be introduced into the container 100 until pressure equilibrium is established or a predetermined cut-off pressure $P_{CUT}$ is reached.

In other words, the changes in pressure in the container 100 during the filling process are dependent on the initial pressure $P_{INI}$ present in the container 100 at the beginning of the filling process, and thus also dependent on the residual gas present in the container 100. The container 100 is filled by the fill product such that the fill product shares the available space with the residual gas. Accordingly, the pressure in the container 100 rises. The resulting pressure curve can therefore also be the means of determining the current filling status of the container 100, and on this basis, for example, the point at which the end of the filling process will be reached can also be determined, based on the initial pressure $P_{INI}$ in the not-yet-filled container 100.

For example, if the container 100 that is evacuated has a nominal volume of one-half liter, and the headroom of the bottle is assumed to be 20 mL, with the space within the product fill pipe 2 below the valves 30, 50, 60 assumed to be 5 mL, an overall volume of 525 mL is present. This is first evacuated by opening the vacuum valve 30.

If the vacuum valve 30 is then closed and the filler valve 50 opened, as shown in FIG. 2, the overall volume of 525 mL is charged with fill product from the fill product feed 5. Because, in the example described, there is an underpressure in the container 100 with respect to the fill product present in the fill product feed 5, the fill product is expelled into the container 100. If the fill product is a carbonated fill product, a high tendency of foaming is to be expected due to the pressure difference. Fill product foam is thus present in the overall volume, including the product fill pipe 2, headroom H and the container's internal space 112.

If this overall volume is evacuated to an absolute pressure of for example 0.1 bar, residual gas with a volume of 52.5 mL, which was present in the container 100 before filling, remains. Depending on the pre-treatment of the container 100, the residual gas is $CO_2$, another inert gas, air, or another gas mixture.

Accordingly, the container 100 can be initially supplied with fill product via the fill product feed 5 until it reaches normal pressure, i.e. the atmospheric pressure, which results in a fill quantity of 472.5 mL.

In order now to reach the nominal volume of for example 510 mL, the fill product must continue to flow via the fill product feed 5 into the container 100, and thereby compress the residual gas, which displaces a volume of 52.5 mL under atmospheric pressure, such that the missing fill quantity of 37.5 mL can be forced in under pressure to reach the desired nominal fill volume of 510 mL.

Consequently, the fill product can be filled via the fill product feed 5 at an absolute pressure of at least 1.4 bar, in order to enable the appropriate compression of the residual gas. If the fill product in the fill product feed 5 is at this pressure, equilibrium of the pressures in the fill product feed 5, the product fill pipe 2 and the internal space 112 of the container 100 will be reached, such that an absolute pressure of 1.4 bar and a total fill quantity in the container 100 of 510 mL are present.

Accordingly, by means of the determination of the pressure in the container 100 prior to the filling of the container 100 with the fill product, the device 1 for filling with a fill product a container 100 can achieve the ending of the filling when a predetermined cut-off pressure $P_{CUT}$ is reached in the container 100. In the example embodiment described above, the predetermined cut-off pressure $P_{CUT}$ is reached in the container 100 by means of supplying the fill product in the fill product feed 5 already at the cut-off pressure $P_{CUT}$. Thus, the filling of the container 100 continues only until equilibrium of the pressure in the internal space 112 of the container 100 and the pressure in the fill product feed 5 is reached.

Measuring and/or supplying the fill product pressure thus determines, in combination with the cut-off pressure $P_{CUT}$, the volume of fill product to be introduced into the container 100, even before the filling process begins.

In order to enable the precise filling of the container 100 with the fill product, it may be necessary, in the example embodiment described, to introduce a gas lock into the product fill pipe 2 or the fill product feed 5, in order to prevent backflow of the residual gas from the container 100 into the fill product feed 5 when the pressures equalize in the container 100, which is at that point nearly full, and the fill product feed 5. If such a backflow of the residual gas into the fill product feed 5 were permitted, the container 100 would be overfilled with the fill product. The backflow of residual gas from the container 100 should therefore be prevented in order to achieve still more precise filling outcomes.

With the equilibrium method, in which at the end of the filling process an equilibrium is established between the pressure present in the internal space 112 of the container 100 and the pressure in the fill product feed 5, the filling process is rapid at the outset. But at its end, prior to the actual establishment of the equilibrium, the filling process decelerates, and finally comes to a standstill when equilibrium is reached.

In one variant, the cut-off pressure $P_{CUT}$, as described above, is again determined from the measured initial pressure $P_{INI}$ in the container 100. For example, a cut-off pressure $P_{CUT}$ of 1.4 bar absolute pressure is again determined based on an initial pressure $P_{INI}$ of 0.1 bar absolute pressure. In this variant however, the fill product in the fill product feed 5 is at a significantly higher pressure, for example, at an absolute pressure of about 1.5 bar to 9 bar.

By means of the pressure gauge 4, when the fill product flows via the fill product feed 5 into the container 100, the changing pressure in the internal space 112 of the container 100 can be monitored, and when the predetermined cut-off pressure $P_{CUT}$ (1.4 bar in the example described) is reached, the filler valve 50 can be closed. The filler valve 50 is thereby closed while in the fill product feed 5 a raised pressure still exists with respect to the pressure in the container 100, which has now been filled. By supplying the fill product at a higher pressure in the fill product feed 5 than the predetermined cut-off pressure $P_{CUT}$, filling of the container 100 can take place rapidly or in a sudden burst, and the filling process can be completed quickly.

Accordingly, the fill product is at an overpressure with respect to the pressure in the container 100 until the filler valve 50 is closed, so that it is possible for the fill product to flow in rapidly. Furthermore, backflow of residual gas from the container 100 into the fill product feed 5 can be prevented, due to the pressure difference and the associated flow of fill product into the container 100. The filling of the container 100 can thus be carried out subject to the pressure ratios which are based on the determination of the cut-off pressure $P_{CUT}$, so that the predetermined fill volume can be reached exactly. It is also possible to dispense with the gas lock described above, since backflow of the residual gas is prevented by the constant pressure difference and the stream of fill product directed exclusively into the container 100.

Figure 3:
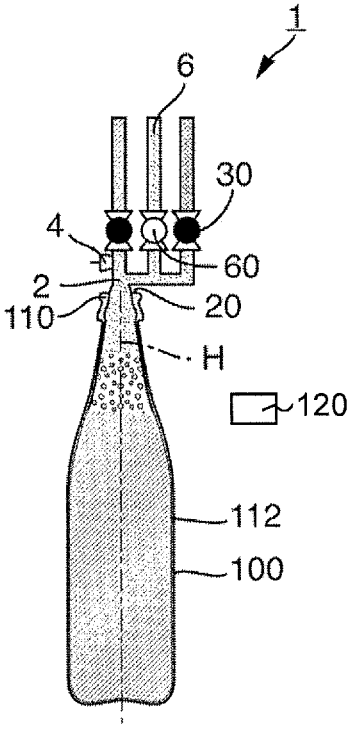
FIG. 3 illustrates the device of FIG. 1 in a third state.

FIG. 3 shows a further step in the method, in which the device 1 for filling the container 100 to be filled with the fill product is connected with the product fill pipe 2 via a pressure gas device 6, which has a pressure gas valve 60, in order to push the residual fill product out of the product fill pipe 2 and push the foamed fill product into the internal space 112 of the container to be filled 100. In this manner, the product fill pipe 2 can be emptied of fill product that is still present, substantially in the form of foam. Furthermore, the fill product can be introduced into the internal space 112 of the container 100 in such a manner that the headroom H also remains substantially free of fill product foam.

Figure 4:
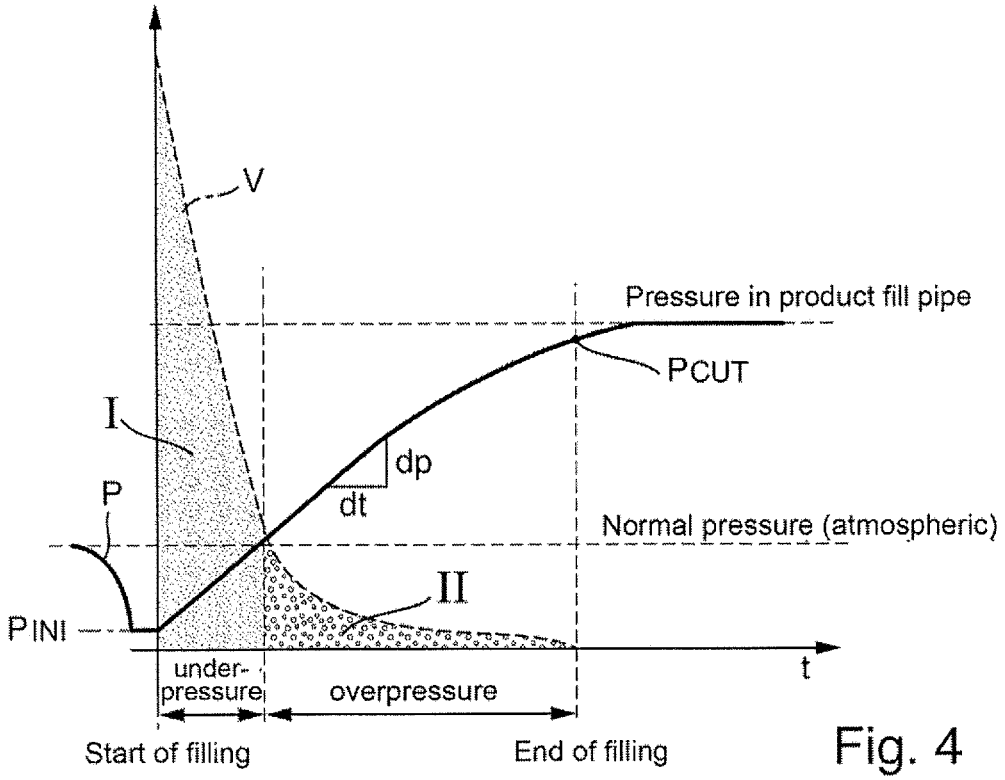
FIG. 4 is a schematic diagram of the changing volume flow of the fill product and the pressure in the container over the course of the filling process.

The interrelationships during the filling process are again shown schematically in FIG. 4, wherein the x-axis shows the time t and the y-axis the volume flow $\dot{V}$. The curve labelled "$\dot{V}$" thereby represents the volume flow of the fill product into the container 100 over time.

The diagram in FIG. 4 also shows a second curve, labelled "P". This represents the pressure P over time in the product fill pipe 2, and hence also the pressure over time in the internal space 112 of the container. The pressure curve P and the curve of the volume flow $\dot{V}$ are correlated, so that the volume flow $\dot{V}$ into the container 100 that is shown at any time corresponds to the pressure P in the container 100 shown at this time.

At the start of the filling process, in a first phase which is labelled "underpressure" in FIG. 4, the volume flow $\dot{V}$ is very high. When the fill product, which is at an overpressure, is introduced into the container to be filled 100, which is at an underpressure relative to the fill product, filling takes place substantially in a sudden burst, in particular in the pressure area in which there is still an underpressure in the container to be filled. Accordingly, the volume flow that results from this pressure difference is very high.

In this manner, it is possible to calculate simply at the same time the volume of fill product that has already been introduced into the container when atmospheric pressure, i.e. 1 bar absolute pressure, is reached. Because the initial pressure $P_{INI}$ in the container to be filled was measured before the product valve was opened, it is possible, from the difference between this and the pressure in the gas volume remaining in the container, to calculate the volume of fluid that is introduced into the container up to the time when atmospheric pressure is reached.

Starting from the point of intersection of the volume flow $\dot{V}$ with the axis of the normal pressure (1 bar), further filling of the container 100 then takes place in the area of FIG. 4 labelled "overpressure", which then results in a pressure P above normal pressure (1 bar) in the container 100. As already mentioned, the fill product feed 5 is generally at an overpressure, or supplies the fill product at an overpressure with respect to the pressure in the container 100. This overpressure applied at the gripping bell 20 of the product fill pipe is a combination of the actual pressure of the fill product in the fill product feed 5 and the hydrostatic pressure, which is governed by the geometry of the particular device 1 for filling a container 100.

The overall volume of fill product to be filled into the container to be filled 100 corresponds to the area under the volume flow curve $\dot{V}$, i.e. the integral of the volume flow $\dot{V}$ over the time period between the beginning of the filling process and its end. The overall fill volume is divided into a first fill volume, labelled "I", in which the container to be filled 100 is at a pressure of up to normal pressure, and a second fill volume, labelled "II", in which the pressure in the container 100 rises above normal pressure.

The overpressure of the fill product accordingly compresses the residual gas remaining in the container 100, starting from normal pressure, until the desired quantity of fill product has been introduced into the container 100. At this point in time, the cut-off pressure $P_{CUT}$ and thereby the end of the filling process is reached, and the filler valve 50 closes.

The end of the filling process can thus be reached in two ways, in one embodiment.

In the first case, the fill product that is supplied via the product fill pipe is supplied already at the cut-off pressure $P_{CUT}$. In this case, filling continues until an equilibrium of the pressures in the container 100 and the fill product feed 5 is established. Here, the actual fill volume introduced into the container reacts sensitively to the initial pressure $P_{INI}$ in the container 100. When the equilibrium pressure is reached, the filler valve 50 can then be closed. This closing of the filler valve 50 is, however, not time-critical, but can be carried out at any time after equilibrium pressure is reached, since due to the fact that the equilibrium pressure has been reached the fill volume in the container 100 no longer changes.

Alternatively, in the second case, the pressure of the fill product in the fill product feed is higher than the predetermined cut-off pressure $P_{CUT}$. In this case, not only the initial pressure $P_{INI}$ is determined by means of the pressure gauge 4; the changing pressure is also measured in the container to be filled 100 during the filling process, and when the predetermined cut-off pressure $P_{CUT}$ is reached the filler valve 50 is closed. Here the pressure in the container 100 is monitored by means of the pressure gauge 4 such that the cut-off pressure $P_{CUT}$ can be reliably determined and exact filling can thereby be achieved.

In still another embodiment, the changing pressure in the container 100, starting from the initial pressure $P_{INI}$, can be analyzed during the filling process, and for example if the change in pressure is less than a predetermined rate of increase or a predetermined differential dP/dt of the pressure P, the filler valve 50 can be closed.

In exemplary embodiments, the initial pressure $P_{INI}$ in the container 100 and the resulting cut-off pressure $P_{CUT}$, or the resulting cut-off rate of increase, or the cut-off differential, can be determined separately for each filling process and for each filling element. It is also possible, if the pressure gauge 4 is disposed centrally on a vacuum device, for the initial pressure $P_{INI}$ to be determined collectively for all filling elements, or for groups of filling elements in a filler carrousel, or else an identical initial pressure $P_{INI}$ can be assumed for all filling processes.

To the extent applicable, all individual features described in the individual example embodiments can be combined with each other and/or exchanged, without departing from the field of the invention.

The invention claimed is:

1. A method for filling a container with a carbonated beverage in a beverage filling plant, which comprises:

connecting the container with a beverage fill pipe to form a seal;

after connecting the container and before filling the container with the carbonated beverage, evacuating the container;

determining an initial pressure in the evacuated container;

filling the evacuated container with the carbonated beverage as pressure in the container rises to reach atmospheric pressure;

after the pressure in the container reaches atmospheric pressure, continuing to fill the container with the carbonated beverage as the pressure in the container rises above atmospheric pressure; and after continuing to fill the container, stopping the filling of the container when an equilibrium of pressures in the container and the beverage fill pipe is reached, or a predetermined cut-off pressure is reached in the container.

2. The method of claim 1, wherein the container is evacuated to an absolute pressure of about 0.5 to 0.05 bar.

3. The method of claim 1, wherein the carbonated beverage is supplied at an absolute pressure of about 1 bar to 9 bar.

4. The method of claim 1, further comprising adjusting the initial pressure according to the predetermined cut-off pressure.

5. The method of claim 1, wherein the carbonated beverage is supplied at the predetermined cut-off pressure.

6. The method of claim 1, wherein the carbonated beverage is at a higher pressure than the pre-determined cut-off pressure during the filling of the evacuated container.

7. The method of claim 6, further comprising measuring a changing pressure in the container.

8. The method of claim 7, further comprising closing a filler valve when one or both of a predetermined rise in the pressure and a predetermined differential of the pressure is reached.

9. The method of claim 1, further comprising determining the predetermined cut-off pressure, wherein determining the predetermined cut-off pressure comprises:

determining an overall volume of the container based on a volume of an internal space of the container and a volume contributed by a product fill pipe; and determining a volume of residual gas in the container at the initial pressure, wherein filling the container with the carbonated beverage comprises filling the container to a first fill volume corresponding to when atmospheric pressure is reached in the container.

10. The method of claim 9, wherein determining the predetermined cut-off pressure further comprises determining a missing fill volume based on a difference between the first fill volume and a desired fill volume.

11. The method of claim 10, wherein the predetermined cut-off pressure is based on a ratio of the volume of residual gas to the missing fill volume, and filling the container with the carbonated beverage further comprises filling the container to a second fill volume corresponding to when the predetermined cut-off pressure is reached in the container.

12. A method for filling a container with a carbonated beverage in a beverage filling plant, which comprises:

evacuating the container so that the container is brought to a first pressure, wherein the first pressure is an underpressure with respect to the carbonated beverage;

determining an initial pressure in the evacuated container;

filling, via a fill product feed, the evacuated container with the carbonated beverage supplied at a second pressure as pressure in the container rises to reach atmospheric pressure;

after the pressure in the container reaches atmospheric pressure, continuing to fill the container with the carbonated beverage as the pressure in the container rises above atmospheric pressure; and after continuing to fill the container, stopping the filling of the container when an equilibrium of pressures in the container and the fill product feed is reached, or a predetermined cut-off pressure is reached in the container.

13. The method of claim 12, wherein the second pressure is an overpressure with respect to the predetermined cut-off pressure, or an overpressure with respect to the initial pressure.

14. The method of claim 13, wherein the overpressure with respect to the initial pressure corresponds to atmospheric pressure or a saturated pressure of the carbonated beverage.

15. The method of claim 14, wherein the saturated pressure is an absolute pressure of about 1.6 to 9 bar.

16. The method of claim 12, wherein the second pressure is equal to the predetermined cut-off pressure.

17. The method of claim 12, further comprising counteracting release of carbon dioxide in the carbonated beverage.

18. A device for filling a container with a carbonated beverage in a beverage filling plant, comprising:

a beverage fill pipe connected to the container to form a seal, wherein the beverage fill pipe is in fluid communication with a beverage feed via a filler valve;

a vacuum line that is configured to evacuate the container after the container is connected to the beverage fill pipe and before the container is filled with the carbonated beverage;

a pressure gauge that is configured to determine an initial pressure in the evacuated container; and a control device that is configured to open the filler valve after the initial pressure is determined in the evacuated container, keep the filler valve open as the container reaches atmospheric pressure for initial filling and after the container reaches atmospheric pressure for further filling, and to close the filler valve after the further filling when an equilibrium of pressures in the container and the beverage fill pipe is reached, or a predetermined cut-off pressure is reached in the container.

* * * * *